US012758080B2

(12) United States Patent
Ballard

(10) Patent No.: US 12,758,080 B2
(45) Date of Patent: Oct. 13, 2026

(54) GLASS WASHING APPARATUS

(71) Applicant: Dale P. Ballard, Redondo Beach, CA (US)

(72) Inventor: Dale P. Ballard, Redondo Beach, CA (US)

( * ) Notice: Subject to any disclaimer, the term of this patent is extended or adjusted under 35 U.S.C. 154(b) by 52 days.

(21) Appl. No.: 18/901,687

(22) Filed: Sep. 30, 2024

(65) Prior Publication Data

US 2025/0288179 A1 Sep. 18, 2025

Related U.S. Application Data

(60) Provisional application No. 63/564,990, filed on Mar. 14, 2024.

(51) Int. Cl.

| | |
|---|---|
| ***A47L 15/00*** | (2006.01) |
| ***A47L 15/42*** | (2006.01) |
| ***A47L 15/48*** | (2006.01) |
| ***A47L 15/50*** | (2006.01) |

(52) U.S. Cl.

CPC ..... *A47L 15/0065* (2013.01); *A47L 15/0028* (2013.01); *A47L 15/0034* (2013.01); *A47L 15/4223* (2013.01); *A47L 15/4278* (2013.01); *A47L 15/4285* (2013.01); *A47L 15/4287* (2013.01); *A47L 15/4293* (2013.01); *A47L 15/486* (2013.01); *A47L 15/488* (2013.01); *A47L 15/505* (2013.01); *A47L 2301/08* (2013.01); *A47L 2401/12* (2013.01); *A47L 2501/05* (2013.01); *A47L 2501/06* (2013.01); *A47L 2501/11* (2013.01); *A47L 2501/12* (2013.01)

(58) Field of Classification Search

None

See application file for complete search history.

(56) References Cited

U.S. PATENT DOCUMENTS

| | | | | |
|---|---|---|---|---|
| 9,451,863 | B1 * | 9/2016 | Larson | A47L 15/0034 |
| 2005/0236345 | A1 * | 10/2005 | Herbst | A47L 15/505 211/41.9 |

* cited by examiner

*Primary Examiner* — Eric W Golightly

(57) ABSTRACT

Glass washing apparatus and related methods clean a glass and suppress formation of water spots. A glass washing apparatus includes a housing, an access door, a glass holder, a first side wash nozzle, a second side wash nozzle, a third side wash nozzle, an interior wash nozzle, a drying air outlet, a clean water tank, a dirty water tank, a wash water pump, a heater/blower unit, a control panel, and a control unit. The control unit receives a start signal from the control panel, controls transmission of power to the wash water heater, controls transmission of power to the wash water pump to supply heated clean water to the first side wash nozzle, the second side wash nozzle, the third side wash nozzle, and the interior wash nozzle; and controls transmission of power to the heater/blower unit to supply a flow of heated air to dry the glass.

16 Claims, 17 Drawing Sheets

GLASS WASHING APPARATUS

CROSS-REFERENCES TO RELATED APPLICATIONS

The present application claims the benefit under 35 USC § 119(e) of U.S. Provisional Appln. No. 63/564,990 filed Mar. 14, 2024; the full disclosure which is incorporated herein by reference in its entirety for all purposes.

BACKGROUND

Wine glasses have a stylish configuration with a base, a stem, and a bowl. Wine glasses come in various configurations such as red wine glasses, white wine glasses, champagne flutes, and sherry glasses. Wine glasses, however, may be prone to staining (e.g., lipstick stains) and the formation of water spots during drying. Wine glasses are also relatively fragile. As a result, many people resort to hand washing wine glasses to avoid spotting of the wine glass and/or breakage.

BRIEF SUMMARY

The following presents a simplified summary of embodiments of the invention in order to provide a basic understanding of the invention. This summary is not an extensive overview of the invention. It is not intended to identify key/critical elements of the invention or to delineate the scope of the invention. Its sole purpose is to present embodiments of the invention in a simplified form as a prelude to the more detailed description that is presented later.

Glass washing apparatus and related methods are described herein that can be used to wash any suitable glass. In embodiments, a glass washing apparatus is configured for automatically washing and drying a glass in a short amount of time while suppressing formation of water spots during drying of the glass. The glass washing apparatus described herein has a compact configuration suitable for countertop usage. The glass washing apparatus described herein may be especially suitable for washing delicate drinking glasses, such as wine glasses.

Thus, in one aspect, a glass washing apparatus includes a housing, an access door, a glass holder, a first side wash nozzle, a second side wash nozzle, a third side wash nozzle, an interior wash nozzle, a drying air outlet, a vent, a clean water tank, a dirty water tank, a wash water heater, a wash water temperature sensor, a wash water pump, a heater/blower unit, a control panel, and a control unit. The housing partially defines a glass washing chamber. The access door is mounted to the housing. The access door is reconfigurable between an open configuration and a closed configuration. The open configuration provides access to the glass washing chamber. In the closed configuration, the access door defines a portion of the glass washing chamber. The glass holder is configured to hold a glass in an inverted orientation within the glass washing chamber. The first side wash nozzle is configured to emit a first side washing spray onto a first exterior portion of the glass. The first side wash nozzle is mounted to a first side wall of the housing that defines a first side surface of the glass washing chamber. The second side wash nozzle is configured to emit a second side washing spray onto a second exterior portion of the glass. The second side wash nozzle is mounted to a second side wall of the housing that defines a second side surface of the glass washing chamber. The third side wash nozzle is configured to emit a third side washing spray onto a third exterior portion of the glass. The third side wash nozzle is mounted to a back wall of the housing that defines a back wall surface of the glass washing chamber. The interior wash nozzle is configured to emit an interior washing spray into an interior cavity of the glass. The interior wash nozzle is mounted to a bottom panel of the housing that defines a bottom surface of the glass washing chamber. The drying air outlet is configured to emit a heated airflow into the glass washing chamber. The vent is configured for venting the glass washing chamber while the access door is in the closed configuration. The clean water tank is configured to receive clean water. The dirty water tank is configured to receive dirty water from the glass washing chamber. The control unit is configured to: (a) receive a start signal from the control panel, (b) control transmission of electrical power to the wash water heater to produce heated clean water by heating the clean water to a designated heated clean water temperature while monitoring a temperature of the heated clean water via the wash water temperature sensor, (c) control transmission of electrical power to the wash water pump to supply the heated clean water to the first side wash nozzle, the second side wash nozzle, the third side wash nozzle, and the interior wash nozzle to spray wash the glass over a wash cycle; and (d) control transmission of electrical power to the heater/blower unit to supply a flow of heated air to the drying air outlet over a drying cycle.

In embodiments, the glass washing apparatus comprises a drain member mounted to the bottom panel. The drain member can include one or more apertures through which the glass washing chamber is in fluid communication with the dirty water tank.

The glass washing apparatus can include more than one drying air outlet. For example, in embodiments, the glass washing apparatus further includes: (a) a second drying air outlet configured to output a second flow of heated air into the glass washing chamber from the second side wall of the housing, and (b) a third drying air outlet configured to output a third flow of heated air into the glass washing chamber from the back wall of the housing. The drying air outlet can be configured to output the flow of heated air into the glass washing chamber from the first side wall of the housing.

In embodiments, the glass washing apparatus is configured to direct heated air into the interior cavity of the glass. For example, the glass washing apparatus can further include an airflow deflector attached to the bottom panel of the housing. The airflow deflector can be shaped to redirect a portion of the third flow of heated air into the interior cavity of the glass. In embodiments of the glass washing apparatus, the drain member includes the airflow deflector and the third drying air outlet is configured to direct the third flow of heated air along the bottom panel to the airflow deflector.

In embodiments of the glass washing apparatus, the first side wash nozzle, the second side wash nozzle, and the third side wash nozzle are distributed substantially uniformly around the glass. For example, in embodiments of the glass washing apparatus: (a) the first side surface has a first side depth from the back wall surface to an inside surface of the access door in the closed configuration, (b) the first side wash nozzle is offset from the inside surface of the access door by less than ¼ of the first side depth, (c) the second side surface has a second side depth from the back wall surface to an inside surface of the access door in the closed configuration, and (d) the second side wash nozzle is offset from the inside surface of the access door by less than ¼ of the second side depth.

In embodiments of the glass washing apparatus, the glass washing chamber is vented to enhance drying of the glass.

For example, the glass washing apparatus can include an airflow vent via which the glass washing chamber is vented to accommodate output of the flow of heated air from the glass washing chamber.

In embodiments, the glass washing apparatus includes an airflow vent via which the dirty water tank is vented. The drain member can be configured to accommodate venting of the glass washing chamber to the dirty water tank to accommodate input of the flow of heated air into the glass washing chamber.

In embodiments, the glass washing apparatus includes a clean water inlet and a dirty water outlet assembly. The clean water inlet can be configured to accommodate filling of the clean water tank with clean water. The dirty water outlet assembly can include a dirty water outlet valve reconfigurable between a closed configuration for retaining the dirty water in the dirty water tank and an open configuration for draining the dirty water from the dirty water tank.

In embodiments, the control panel is configured for receiving user input and displaying output. For example, the control panel can be configured to: (a) display a designated duration for the wash cycle, and (b) accept user input to adjust the designated duration of the wash cycle. In embodiments, the control panel is configured to: (a) display a designated heated clean water temperature, and (b) accept user input to adjust the designated heated clean water temperature. In embodiments, the control panel is further configured to: (a) display a designated duration for the drying cycle, and (b) accept user input to adjust the designated duration of the drying cycle. In embodiments, the control panel is further configured to: (a) display a designated heated air temperature for the flow of heated air, and (b) accept user input to adjust the designated heated air temperature for the flow of heated air.

In embodiments, the glass washing apparatus is configured for washing a wine glass comprising a base, a bowl, and a stem connecting the base and the bowl. The glass holder can include a support member for supporting the wine glass via the base. The support member can have a slot configured to accommodate the stem. The glass holder can be reconfigurable between a deployed configuration for holding the wine glass and a stowed configuration that accommodates a removable glass holder within the glass washing chamber for holding a glass in an inverted orientation.

In another aspect, a method of cleaning a glass is provided. The method includes: (a) receiving clean water into a clean water tank of a glass washing apparatus, (b) supporting a glass in an inverted orientation within a glass washing chamber of the glass washing apparatus, (c) receiving, by a control unit of the glass washing apparatus, a start signal from a control panel of the glass washing apparatus, (d) controlling, by the control unit, transmission of electrical power to a wash water heater of the glass washing apparatus to heat the clean water to produce heated clean water having a designated wash water temperature, (e) controlling, by the control unit, transmission of electrical power to a water pump of the glass washing apparatus to direct a first side washing spray, a second first side washing spray, and a third side washing spray of the heated clean water onto the glass; and an interior washing spray into an interior cavity of the glass, and (f) controlling, by the control unit, transmission of electrical power to a heater/blower unit of the glass washing apparatus to supply a flow of heated air that is directed into the glass washing chamber to dry the glass. In embodiments, the method further includes receiving, by the control unit, user input of one or more wash cycle parameter values via the control panel.

In embodiments, the method further includes receiving dirty water from the glass washing chamber into a dirty water tank of the glass washing apparatus. In embodiments of the method: (a) the heater/blower unit supplies the flow of heated air into the glass washing chamber through a first side wall of the glass washing chamber, (b) the heater/blower unit supplies a second flow of heated air into the glass washing chamber through a second side wall of the glass washing chamber, and (c) the heater/blower unit supplies a third flow of heated air into the glass washing chamber through a back wall of the glass washing chamber. In embodiments, the method further includes redirecting a portion of the third flow of heated air into the interior cavity of the glass via an airflow deflector.

For a fuller understanding of the nature and advantages of the present invention, reference should be made to the ensuing detailed description and accompanying drawings. Other aspects, objects and advantages of the invention will be apparent from the drawings and detailed description that follows.

BRIEF DESCRIPTION OF THE DRAWINGS

For a more complete understanding of the present invention and its features and advantages, reference is now made to the following description, taken in conjunction with the accompanying drawings, in which:

FIG. 18 shows a cross-sectional view through the cleaning accessory of FIG. 16 and FIG. 17.

DETAILED DESCRIPTION

In the following description, details are set forth by way of example to facilitate discussion of the disclosed subject matter. It should be apparent to a person of ordinary skill in the field, however, that the disclosed embodiments are exemplary and not exhaustive of all possible embodiments.

Figure 1:
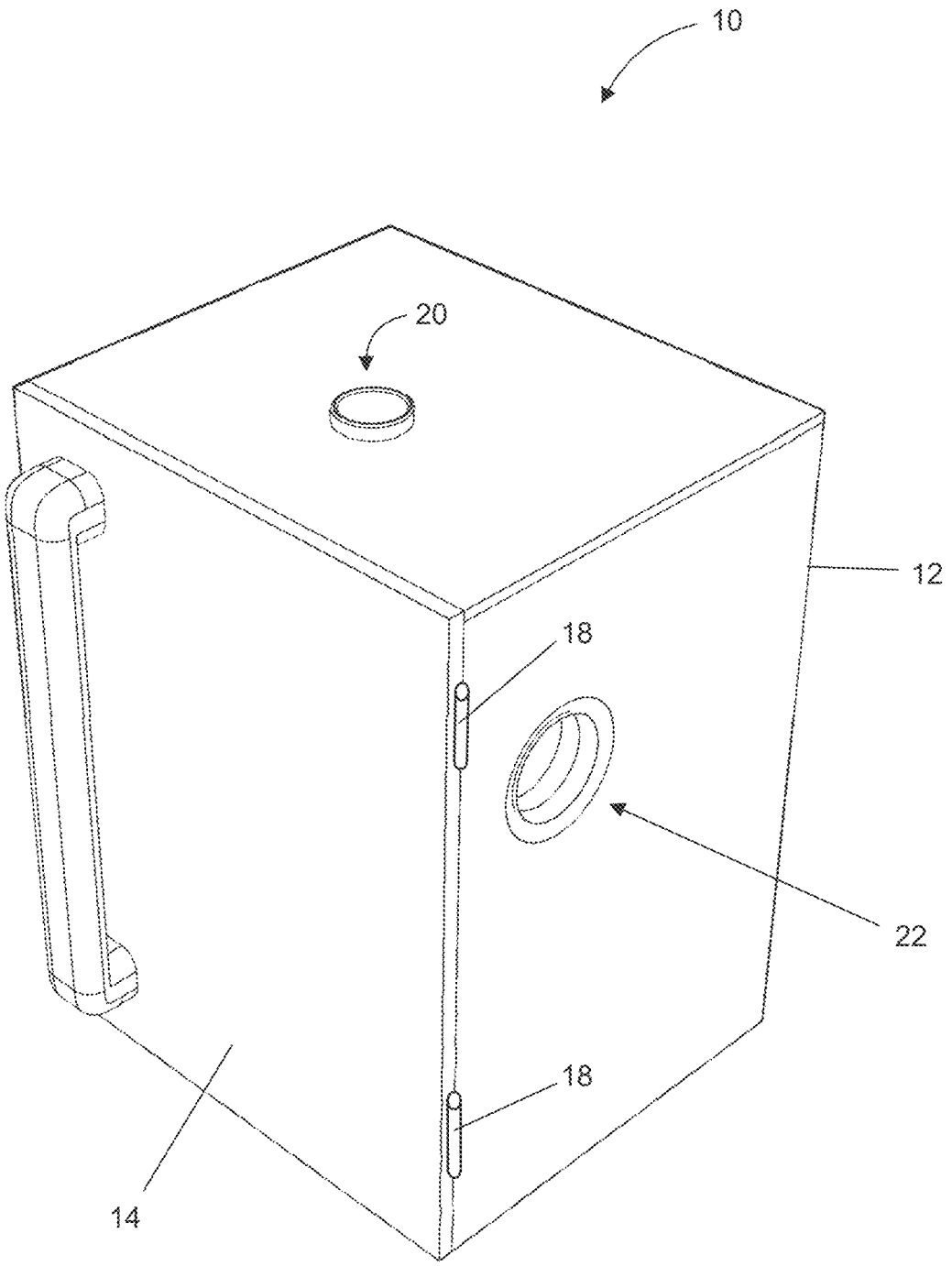
FIG. 1 shows an exterior view of a glass washing apparatus, in accordance with embodiments.

Turning now to the drawing figures in which similar reference identifiers refer to similar elements, FIG. 1 shows an exterior view of a glass washing apparatus 10, in accordance with embodiments. The glass washing apparatus 10 includes a housing 12 and an access door 14. The housing 12 and the access door 14 (when closed) define a glass washing chamber 16 (shown in FIG. 2). The housing 12 partially defines the glass washing chamber 16. The access door 14 is mounted to the housing 12 via hinges 18. The access door 14 is reconfigurable between an open configuration providing access to the glass washing chamber 16 and a closed configuration in which the access door 14 defines a portion of the glass washing chamber 16. The glass washing apparatus 10 includes a clean water inlet 20 and a drying air outlet 22. In embodiments, the clean water inlet 20 includes a removable clean water inlet cap. In embodiments, the glass washing apparatus 10 is sized and configured for countertop usage.

Figure 2:
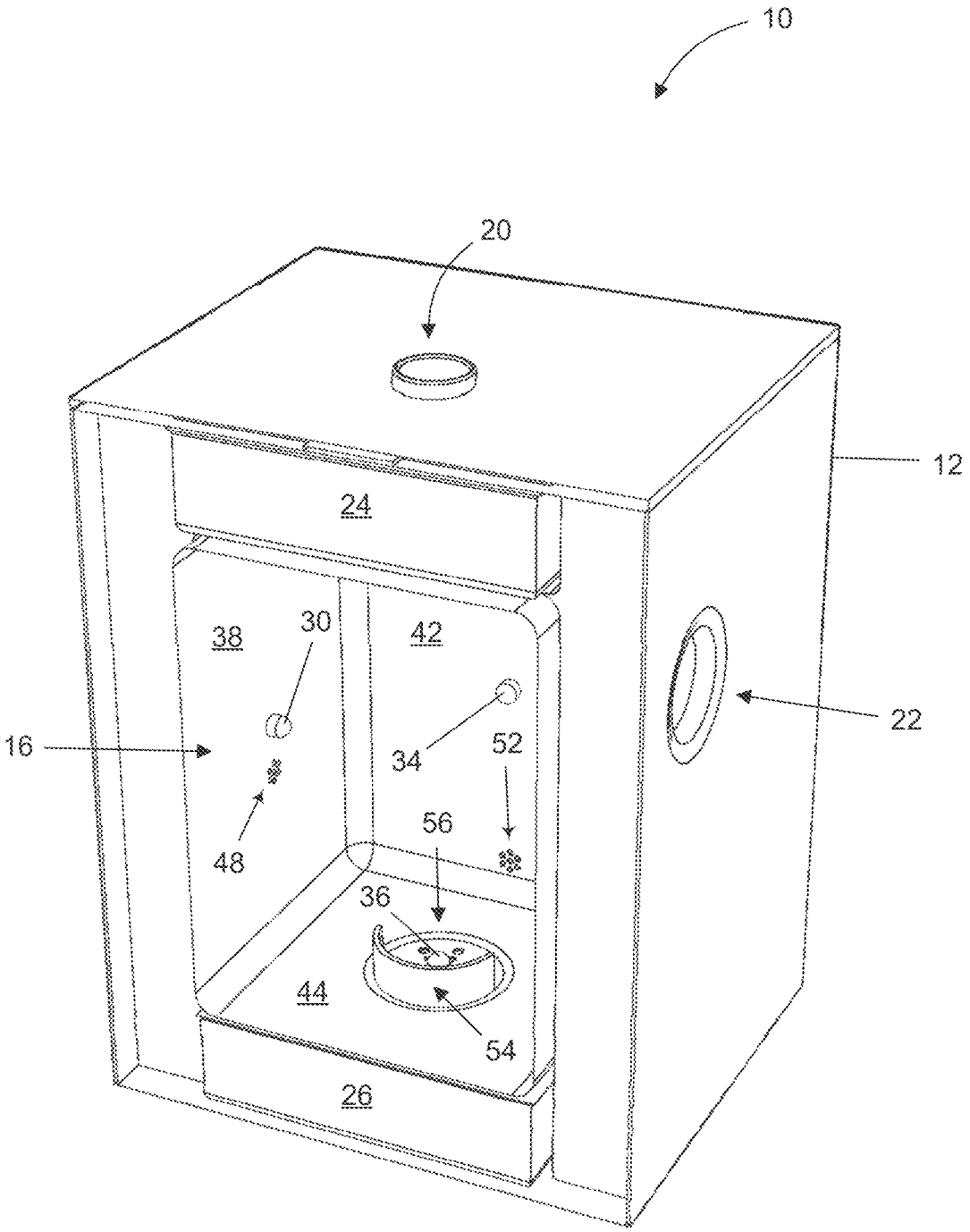
FIG. 2 shows a partial view of the glass washing apparatus of FIG. 1 showing a clean water tank, a glass washing chamber, and a dirty water tank.
Figure 3:
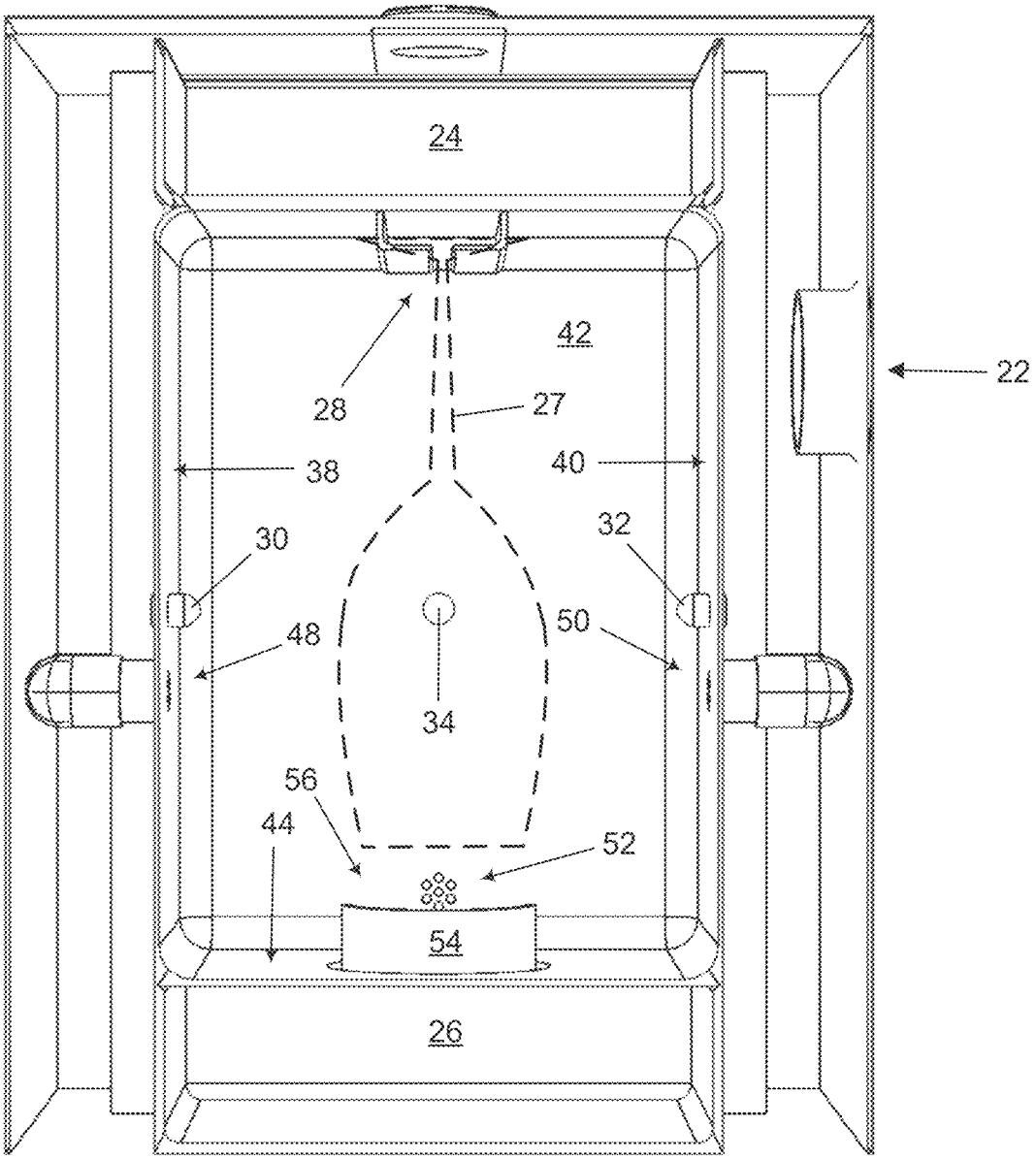
FIG. 3 shows a front cross-sectional view through the clean water tank, the glass washing chamber, and the dirty water tank of the glass washing apparatus of FIG. 1.
Figure 4:
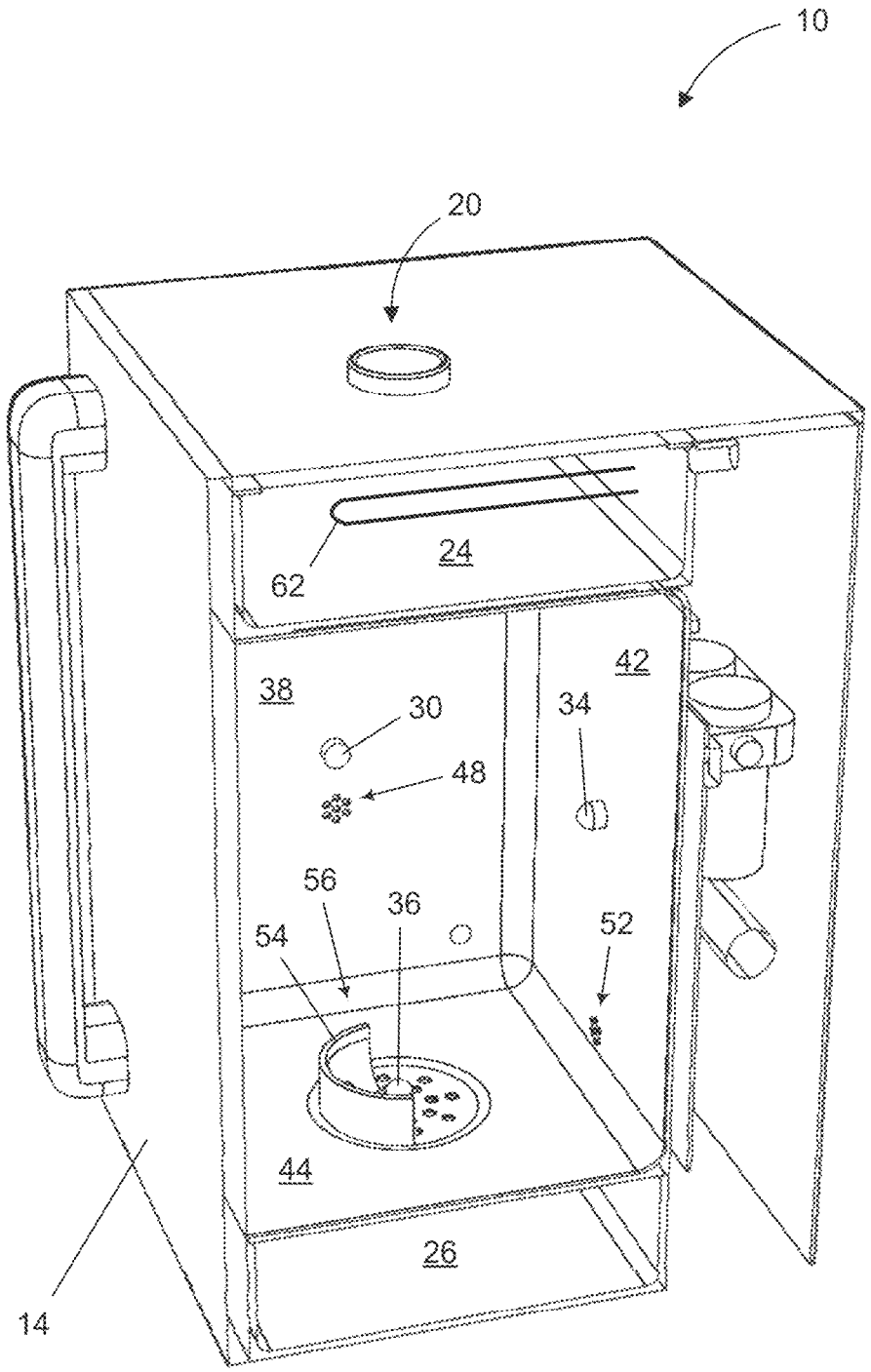
FIG. 4 shows a side cross-sectional view through the clean water tank, the glass washing chamber, and the dirty water tank of the glass washing apparatus of FIG. 1.

FIG. 2 shows a partial front-side view of the glass washing apparatus 10 (with the access door 14 not shown). The glass washing apparatus 10 includes the glass washing chamber 16, a clean water tank 24, and a dirty water tank 26. FIG. 3 shows a front cross-sectional view through the clean water tank 24, the glass washing chamber 16, and the dirty water tank 26 of the glass washing apparatus 10. FIG. 4 shows a first side cross-sectional view through the clean water tank 24, the glass washing chamber 16, and the dirty water tank 26 of the glass washing apparatus 10. The glass washing chamber 16 is sized to accommodate and support a glass 27 in an inverted orientation for washing and drying of the glass by the glass washing apparatus 10. The glass washing apparatus 10 includes a glass holder 28 configured to hold the glass in the inverted orientation within the glass washing chamber 16.

The glass washing apparatus 10 includes a first side wash nozzle 30, a second side wash nozzle 32, a third side wash nozzle 34, and an interior wash nozzle 36. The first side wash nozzle 30 is configured to emit a first side washing spray onto a first side exterior portion of the glass. The first side wash nozzle 30 is mounted to a first side wall 38 of the housing 12. The first side wall 38 defines a first side surface of the glass washing chamber 16. The second side wash nozzle 32 is configured to emit a second side washing spray onto a second exterior portion of the glass. The second side wash nozzle 32 is mounted to a second side wall 40 of the housing 12 that defines a second side surface of the glass washing chamber 16. The third side wash nozzle 34 is configured to emit a third side washing spray onto a third exterior portion of the glass. The third side wash nozzle 34 is mounted to a back wall 42 of the housing that defines a back wall surface of the glass washing chamber 16. The interior wash nozzle 36 is configured to emit an interior washing spray into an interior cavity of the glass. The interior wash nozzle 36 is mounted to a bottom panel 44 of the housing 12 that defines a bottom surface of the glass washing chamber 16.

The glass washing apparatus 10 includes a drain assembly 56 mounted to the bottom panel 44. The glass washing chamber 16 is in fluid communication with the dirty water tank 26 through the drain assembly 56. In the illustrated embodiment, the interior wash nozzle 36 is integrated into the drain assembly 56.

The glass washing apparatus 10 includes at least one drying air outlet for outputting at least one flow of heated air into the glass washing chamber 16 to dry the glass following washing of the glass. In the illustrated embodiment, the glass washing apparatus 10 includes a first side drying air outlet 48, a second side drying air outlet 50, and a back side drying air outlet 52. The first side drying air outlet 48 extends through the first side wall 38. The first side drying air outlet 48 is configured to output a first side drying airflow onto a first side of the glass. The second side drying air outlet 50 extends through the second side wall 40. The second side drying air outlet 50 is configured to output a second side drying airflow onto a second side of the glass, which may or may not be opposite to the first side of the glass. The back side drying air outlet 52 extends through the back wall 42 near the bottom of the back wall 42. The back side drying air outlet 52 is configured to output a back side drying airflow onto an airflow deflector 54. The airflow deflector 54 is shaped to redirect at least a portion of the back side drying air (output by the outlet 52) upward into the interior cavity of the glass. In the illustrated embodiment, the airflow deflector 54 is integrated into the drain assembly 56.

The glass washing chamber 16 is vented to the surrounding environment via the drying air outlet 22 while the access door 14 is in the closed configuration. The housing 12 can be configured to provide an air passageway between the glass washing chamber 16 and the drying air outlet 22 to accommodate flow of warm moist air from the glass washing chamber 16 to the drying air outlet 22 during the drying cycle. For example, the glass washing apparatus 10 can include a glass washing chamber vent that vents moist warm air directly from the glass washing chamber 16 for output from the glass washing apparatus 10 via the drying air outlet 22. In embodiments, the glass washing chamber 16 is vented into the dirty water tank 26 through the drain assembly 56 and the glass washing apparatus 10 includes a dirty water tank vent that vents moist warm air from the dirty water tank 26 for output from the glass washing apparatus 10 via the drying air outlet 22.

Figure 5:
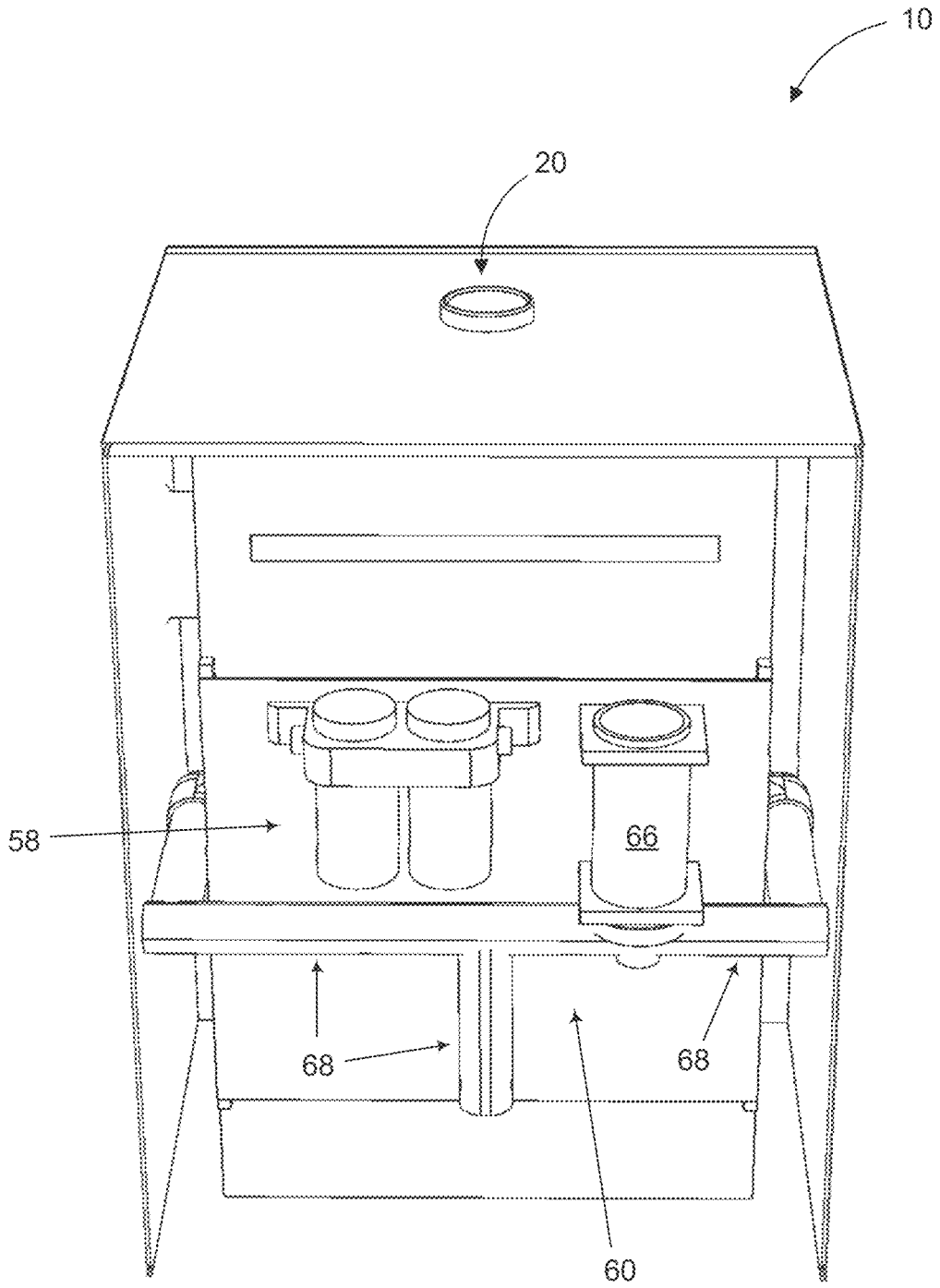
FIG. 5 shows a rear cross-sectional view of the glass washing apparatus of FIG. 1 showing internal components.

Referring now to FIG. 5, the glass washing apparatus 10 further includes a wash water pump assembly 58 and a drying air assembly 60. A wash water heater element 62 (shown in FIG. 4) extends into the clean water tank 24 for heating the clean water in the clean water tank 24. The wash water pump assembly 58 is configured to draw heated clean water from the clean water tank 24 and pressurize the clean water for delivery to the first side wash nozzle 30, the second side wash nozzle 32, the third side wash nozzle 34, and the interior wash nozzle 36. In embodiments, electrical power supplied to the wash water heater element 62 is controlled so that the heated clean water has a designated heated water temperature suitable for use in washing the glass (e.g., 140 to 155 degrees Fahrenheit). The wash water pump assembly 58 can further includes a water filter (not shown) configured to remove most minerals and chemicals from the clean water pumped from the clean water tank 24 to produce soft water, which can help to further inhibit formation of water spots on the glass. The water filter can employ a suitable replaceable filtration cartridge for removing most minerals and chemicals from the clean water. The drying air assembly 60 includes a heater/blower unit 66 and an airflow manifold 68. The heater/blower unit 66 draws an airflow (e.g., from outside of the housing 12), heats the airflow, and outputs the resulting heated airflow into the airflow manifold 68. The housing 12 can include a vent via which the airflow drawn into the heater/blower unit 22 is drawn. The airflow manifold 68 is configured to distribute the heated airflow from the heater/blower unit 66 to the first side drying air outlet 48, the second side drying air outlet 50, and the back side drying air outlet 52.

Figure 6:
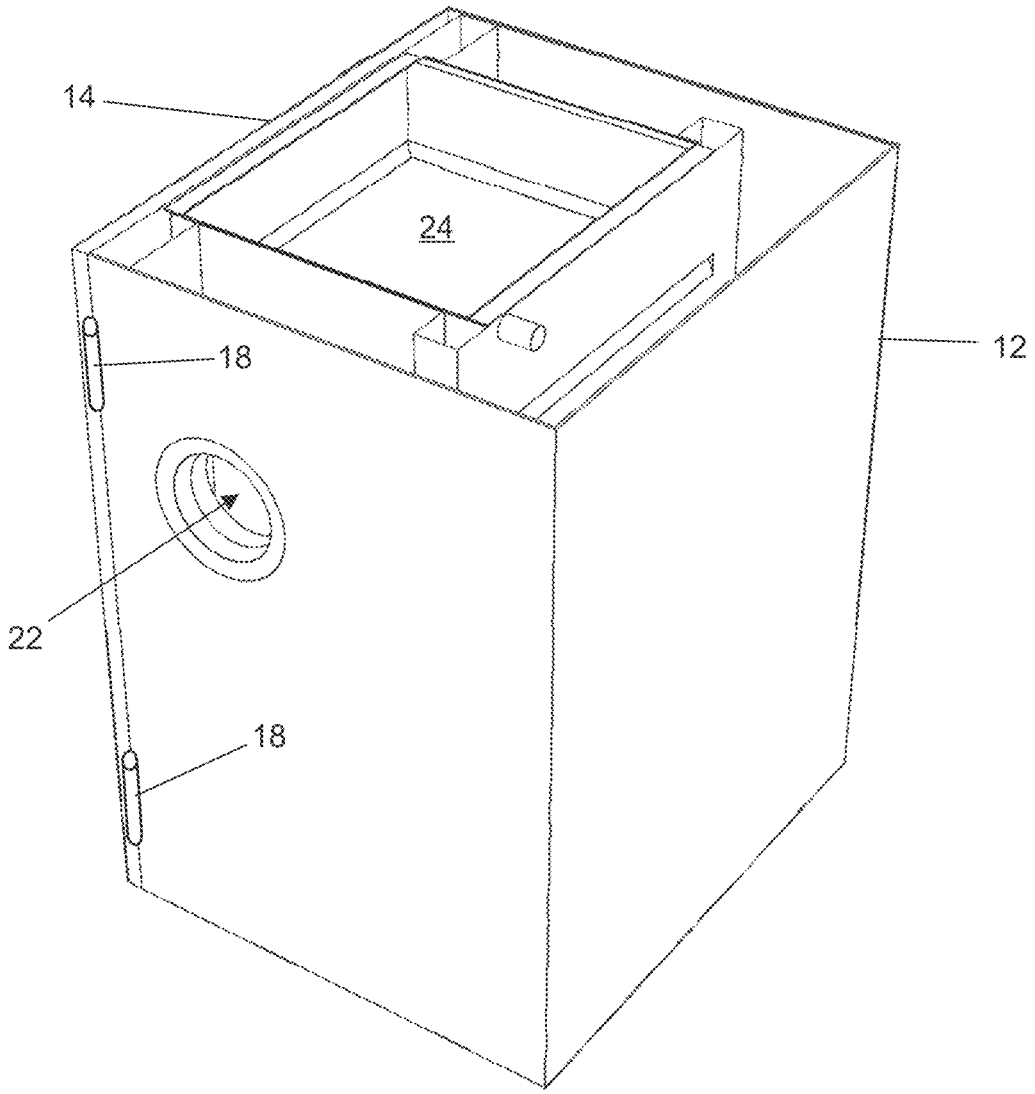
FIG. 6 shows a horizontal cross-sectional view through the clean water tank of the glass washing apparatus of FIG. 1.
Figure 7:
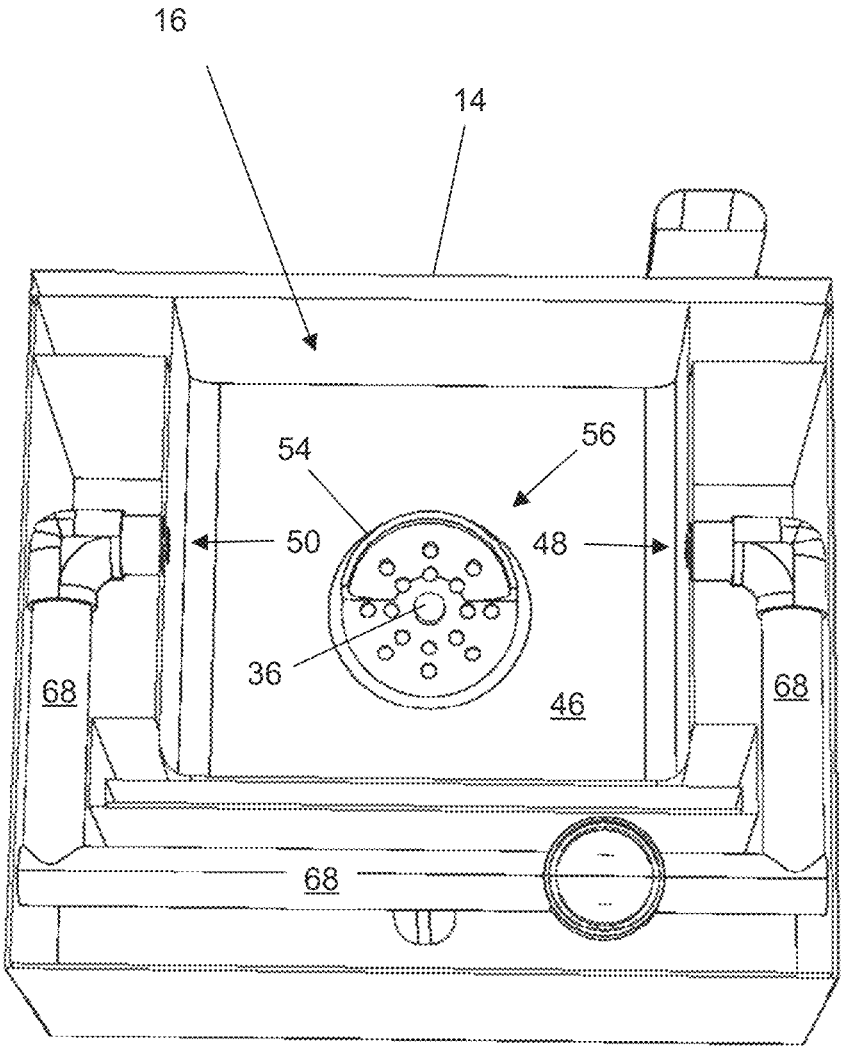
FIG. 7 shows a horizontal cross-sectional view through the glass washing chamber of the glass washing apparatus of FIG. 1 showing a drying air flow manifold.
Figure 8:
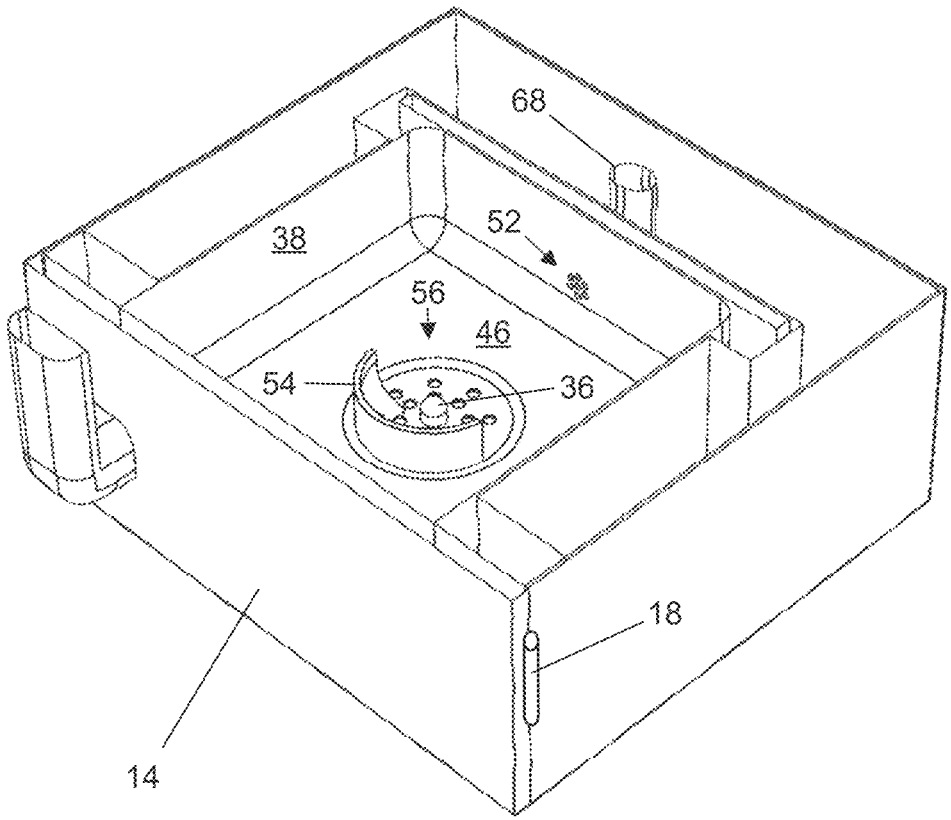
FIG. 8 shows a horizontal cross-sectional view through a bottom portion of the glass washing chamber of the glass washing apparatus of FIG. 1.
Figure 9:
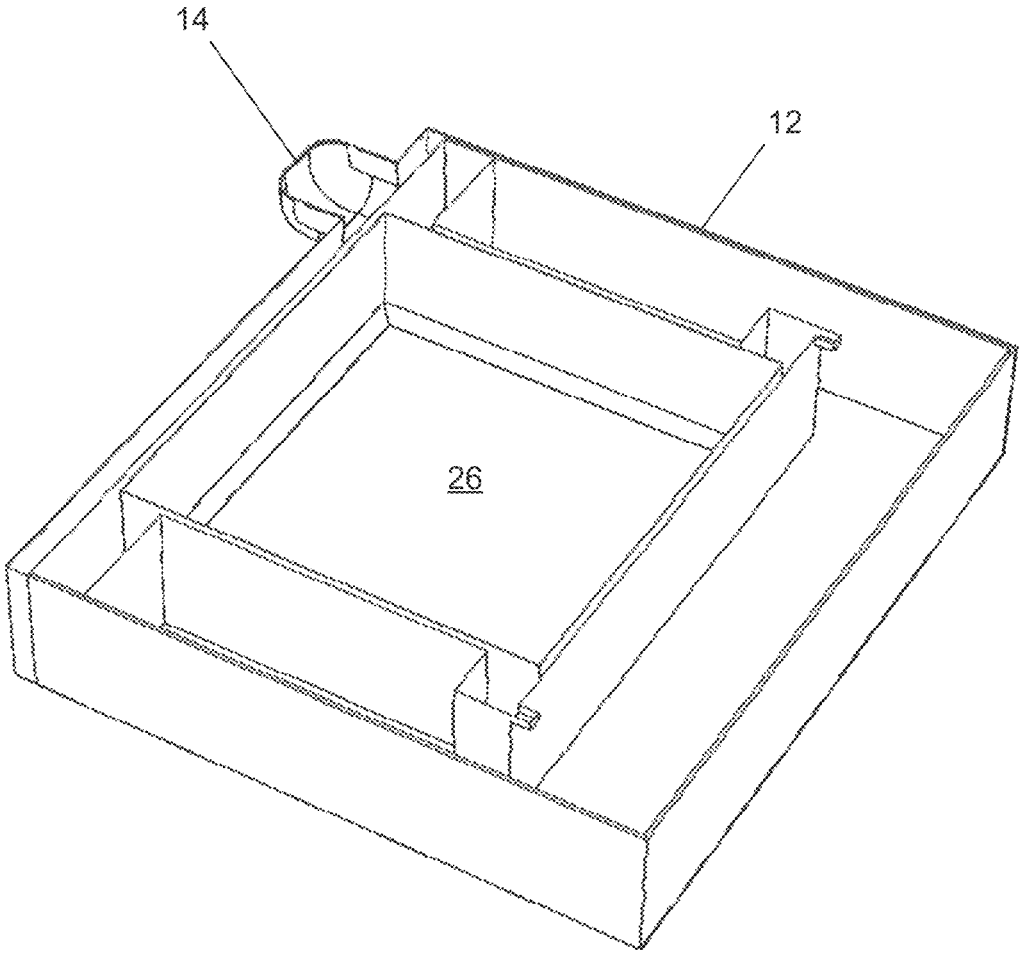
FIG. 9 shows a horizontal cross-sectional view through the dirty water tank of the glass washing apparatus of FIG. 1.

FIG. 6, FIG. 7, FIG. 8, and FIG. 9 show additional cross-sectional views through the glass washing apparatus 10. FIG. 6 shows a horizontal cross-sectional view through the clean water tank 24. FIG. 7 shows a horizontal cross-sectional view through the glass washing chamber 16 that shows the airflow manifold 68. FIG. 8 shows a horizontal cross-sectional view through a bottom portion of the glass washing chamber 16. As discussed above, heated air output from the back side drying air outlet 52 is redirected by the airflow deflector 54 upward into the interior cavity of the glass. FIG. 9 shows a horizontal cross-sectional view through the dirty water tank 26.

Figure 10:
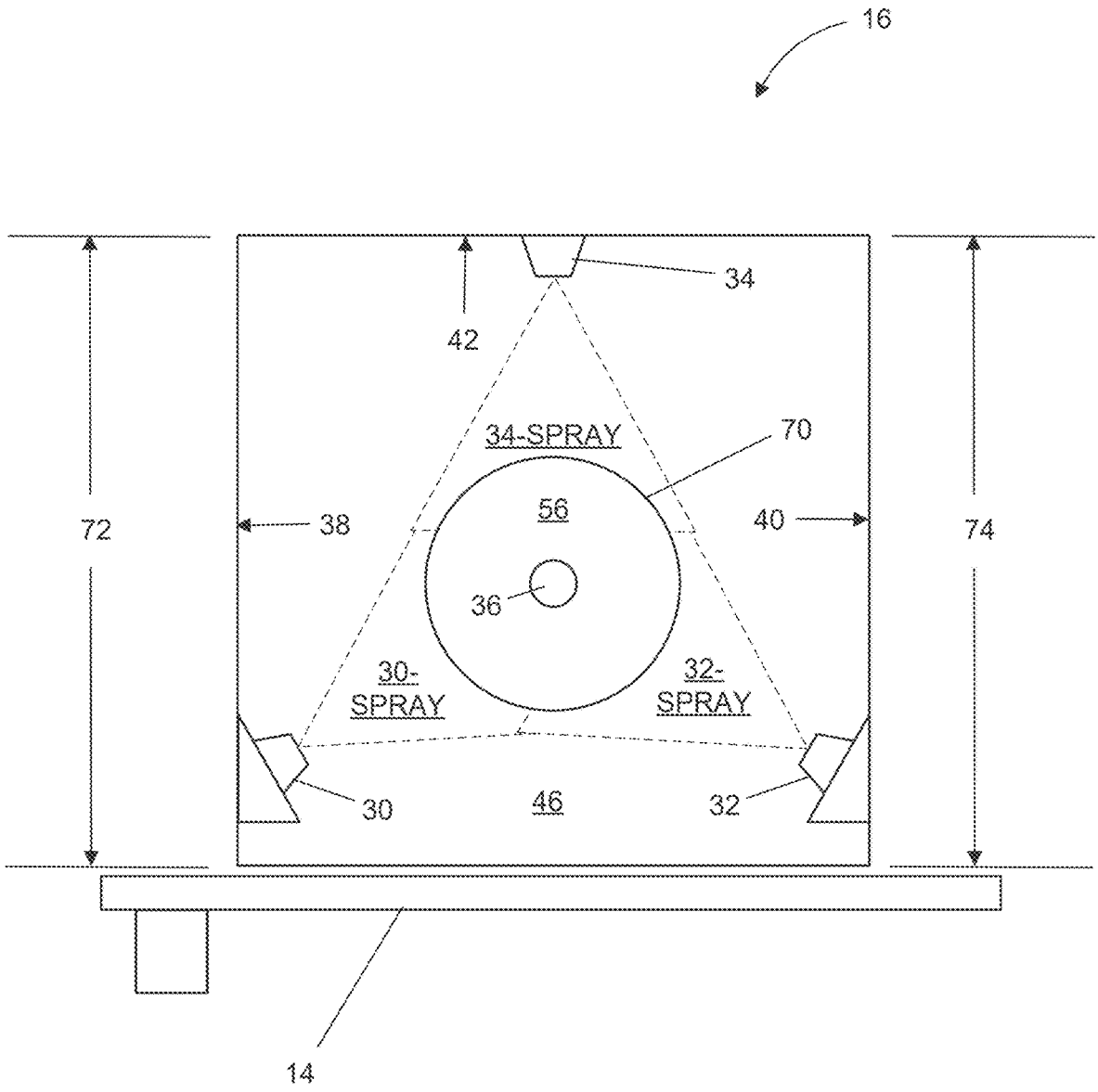
FIG. 10 shows a plan view schematic illustration of positions and orientation of side-wash nozzles for an embodiment of the glass washing apparatus of FIG. 1.

FIG. 10 shows a plan view schematic illustration of positions and orientation of the first side wash nozzle 30, the second side wash nozzle 32, and the third side wash nozzle 34 for an embodiment of the glass washing apparatus 10. In the illustrated embodiment, the first side wash nozzles 30, the second side wash nozzle 32, and the third side wash nozzle 34 are distributed substantially uniformly around a glass 70 suspended from the glass holder 28 (shown in FIG. 3) over the interior wash nozzle 36. Each of the first side wash nozzle 30 and the second side wash nozzle 32 is positioned adjacent to the access door and oriented to spray the heated clean water toward are the glass 70. In embodiments of the glass washing apparatus 10: (a) the first side wall 38 has a first side wall depth 72 from the back wall 42 to the access door 14 in the closed configuration, (b) the first side wash nozzle 30 is offset from the inside surface of the access door 14 by less than ¼ of the first side wall depth 72, (c) the second side wall 40 has a second side wall depth 74 from the back wall 42 to the access door 14 in the closed configuration, and (d) the second side wash nozzle 32 is offset from the access door by less than ¼ of the second side depth 74. The third side wash nozzle 34 is centered on the back wall 42 and oriented to spray the heated clean water forward onto the glass 70. As shown in FIG. 10, the first side wash nozzle 30, the second side wash nozzle 32, and the third side wash nozzle 34 are positioned, oriented, and configured to produce overlapping output sprays 30-SPRAY, 32-SPRAY, and 34-SPRAY configured to effectively cover the exterior surfaces of the glass 70.

Figure 11:
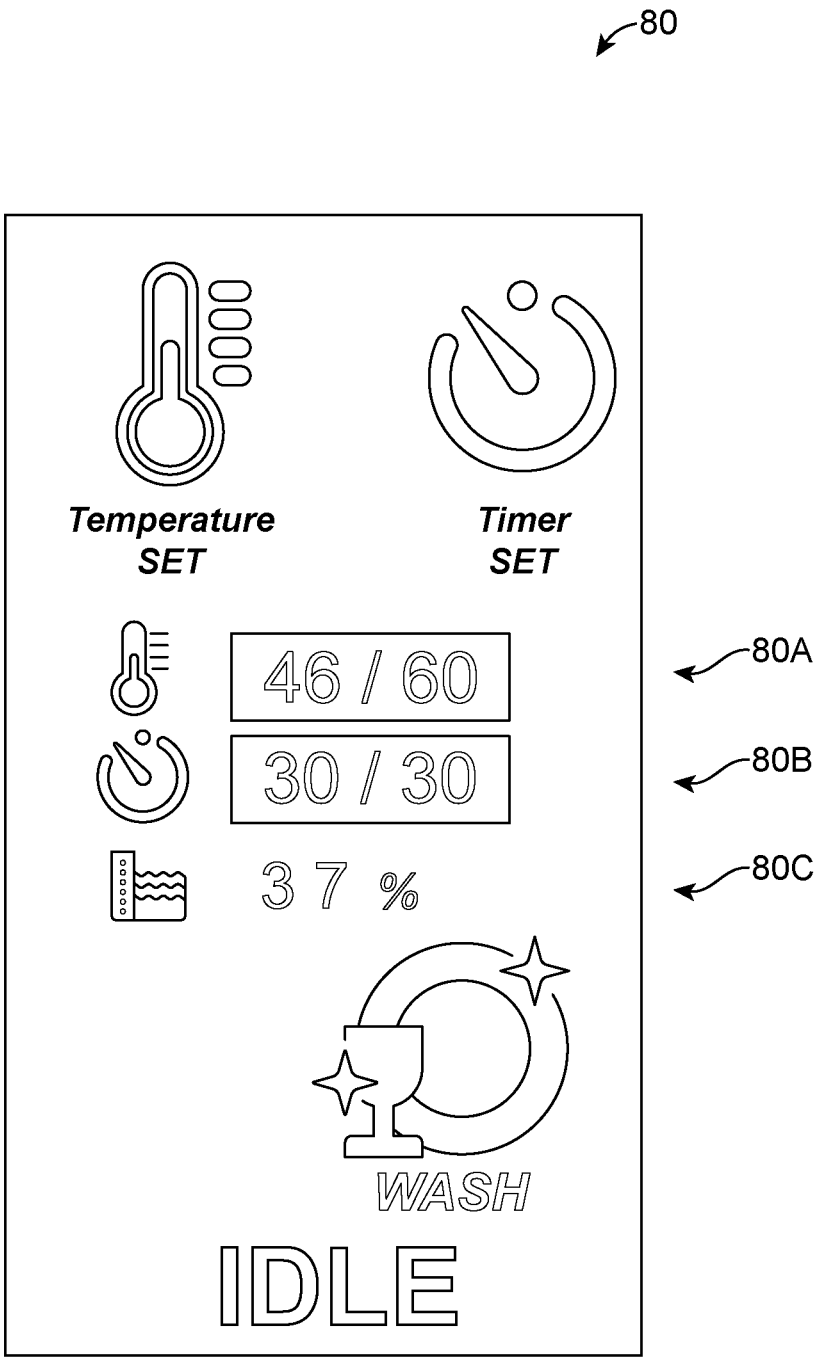
FIG. 11 shows a top level user interface screen for a touch screen control panel of the glass washing apparatus of FIG. 1.

FIG. 11 shows a top level user interface screen 80 for the touch screen control panel 76. The top level user interface screen 80 includes a display 80A for the current temperature of the clean wash water (e.g., the first number "46" in FIG. 11) and the selected temperature for the clean wash number (e.g., the second number "60" in FIG. 11), a display 80B for the remaining time (e.g., the first number "30" in FIG. 11 in seconds) for the wash cycle and the selected total time (e.g., the second number "30" in FIG. 11 in seconds) for the wash cycle, and a display 80C of an indication of the level (e.g., percentage in FIG. 11) of the clean water in the wash water tank 24. The top level user interface can also be configured to display a message that indicates that the dirty water tank needs to be emptied when the level of dirty water in the dirty water tank 26 exceeds a threshold.

Figure 12:
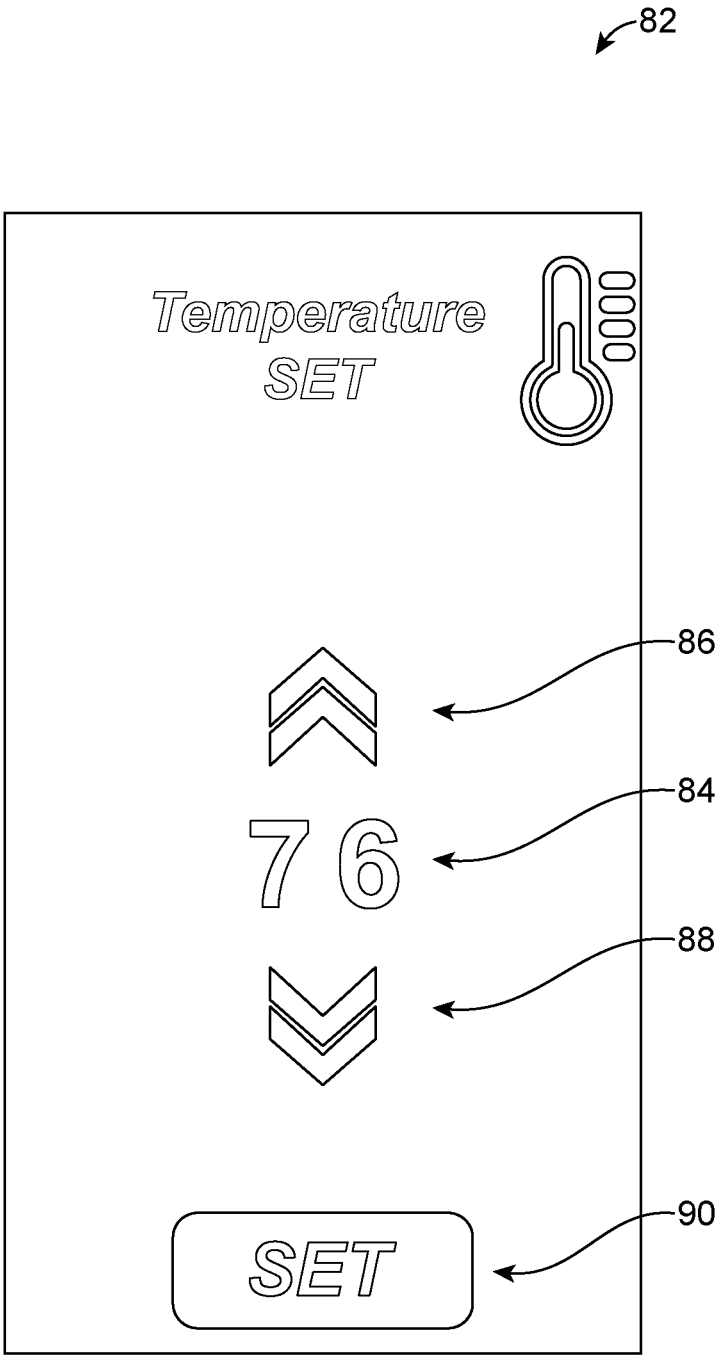
FIG. 12 shows a wash water temperature setting screen for the touch screen control panel of FIG. 11.

FIG. 12 shows a wash water temperature setting screen 82 for the touch screen control panel 76. The wash water temperature setting screen 82 displays a designated wash water temperature 84, an increase temperature arrow 86, a decrease temperature arrow 88, and a set temperature input 90. The designated wash water temperature 84 can be increased by pressing the increase temperature arrow 86 and can be decreased by pressing the decrease temperature arrow 88. The wash water temperature for use in washing the glass 70 can be set to the designated wash water temperature 84 by pressing the set temperature input 90.

Figure 13:
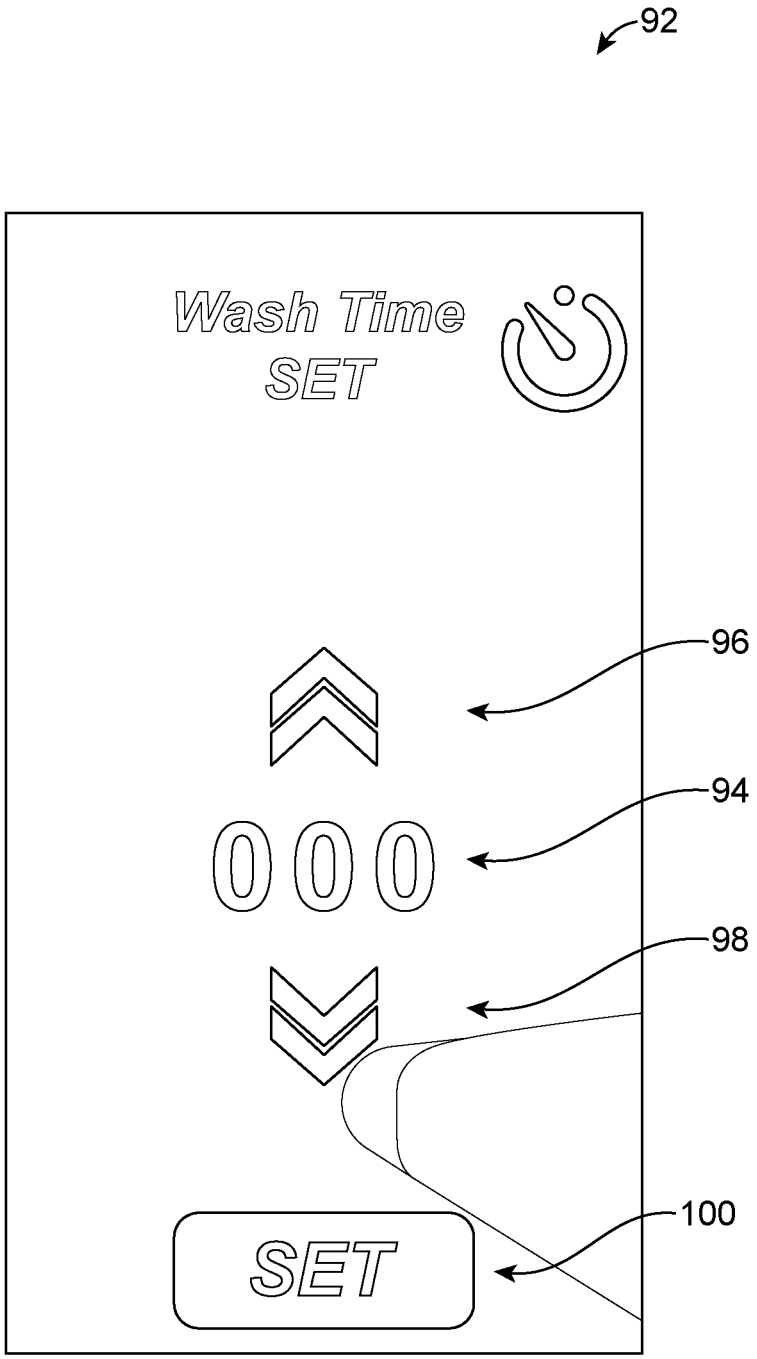
FIG. 13 shows a wash duration setting screen for the touch screen control panel of FIG. 11.

FIG. 13 shows a wash cycle duration setting screen 92 for the touch screen control panel 76. The wash cycle duration setting screen 92 displays a designated duration of the wash cycle 94, an increase wash cycle duration arrow 96, a decrease wash cycle duration arrow 98, and a set wash cycle duration input 100. The designated wash cycle duration 94 can be increased by pressing the increase wash cycle duration arrow 96 and can be decreased by pressing the decrease wash cycle duration arrow 98. The wash cycle duration for use in washing the glass 70 can be set to the designated wash cycle duration 94 by pressing the set wash cycle duration input 100.

Figure 14:
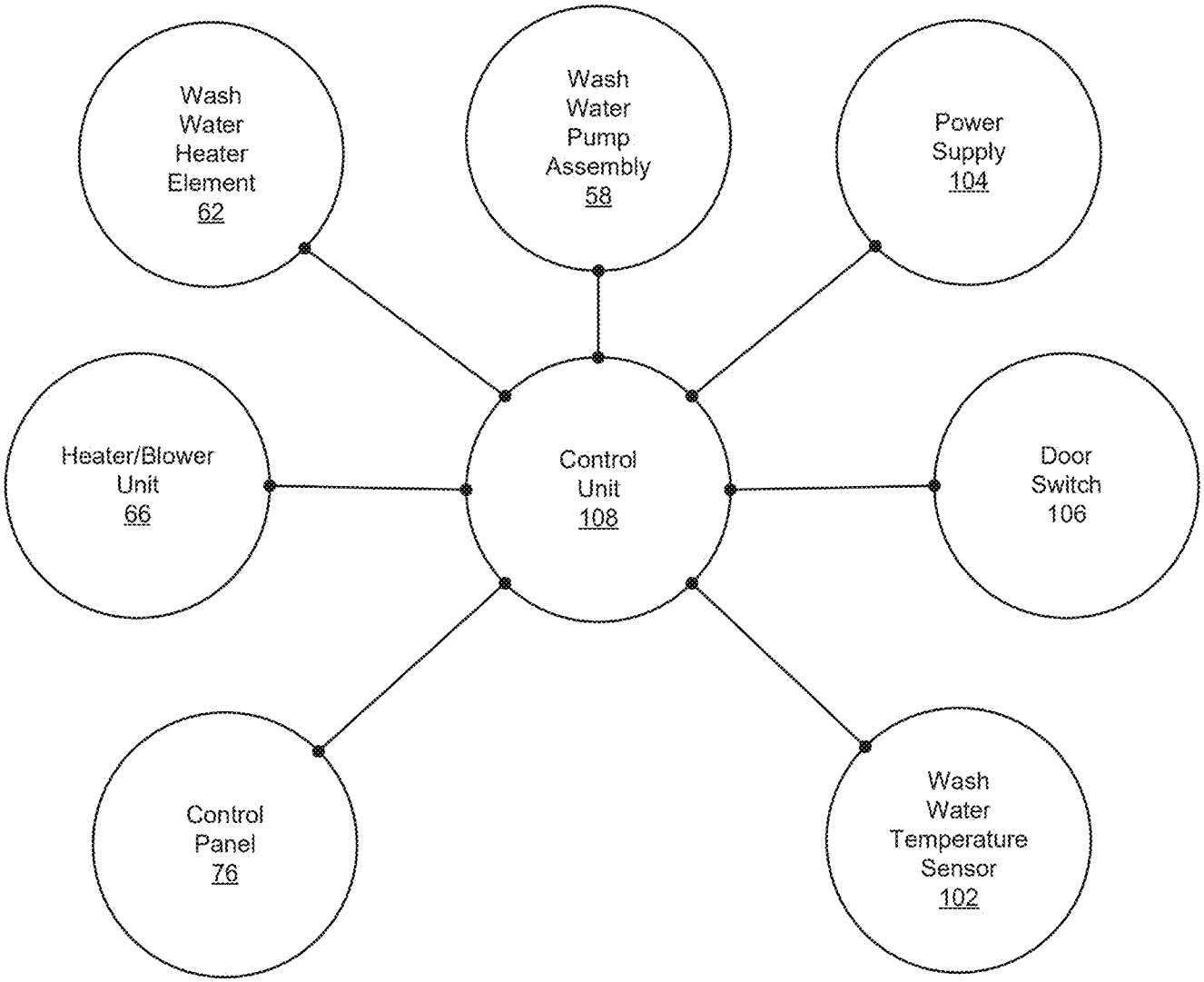
FIG. 14 shows a schematic diagram of a components of the glass washing apparatus of FIG. 1.

FIG. 14 shows a schematic diagram of a components of the glass washing apparatus 10. The components of the glass washing apparatus 10 include the wash water pump assembly 58, the wash water heater element 62, the heater/blower unit 66, the touch-screen control panel 76, a wash water temperature sensor 102, a power supply 104, a door switch 106, and a control unit 108. The control unit 108 is operatively connected to each of the wash water pump assembly 58, the wash water heater element 62, the heater/blower unit 66, the touch-screen control panel 76, the wash water temperature sensor 102, the power supply 104, and the door switch 106. The control unit 108 is configured to control operation of the glass washing apparatus 10.

The control unit 108 is configured to control the touch-screen control panel 76 to display operational parameters of the glass washing apparatus 10 and to receive user input for designating operational parameters and to initiate a wash cycle. For example, the control unit 108 can control the touch-screen control panel 76 to display the top level user interface screen 80 (shown in FIG. 11), the wash water temperature setting screen 82 (shown in FIG. 12), and the wash cycle duration setting screen 92 (shown in FIG. 13). In response to a start wash cycle input received via the top level user interface screen 80, the control unit 108 can control the various components of the glass washing apparatus 10 (as described herein in relation to the method 100 illustrated in FIG. 15) to wash and dry the glass 70.

In embodiments, the door switch 106 is electrically connected to the control unit 108 and configured for use in monitoring whether the access door 14 is open or closed. In embodiments, the control unit 108 is configured to: (a) prevent any powering of the wash water pump assembly 58, the wash water heater element 62, and the heater/blower unit 66 while the access door 14 is open, and (b) enable powering of the wash water pump assembly 58, the wash water heater element 62, and the heater/blower unit 66 while the access door 14 is closed.

Figure 15:
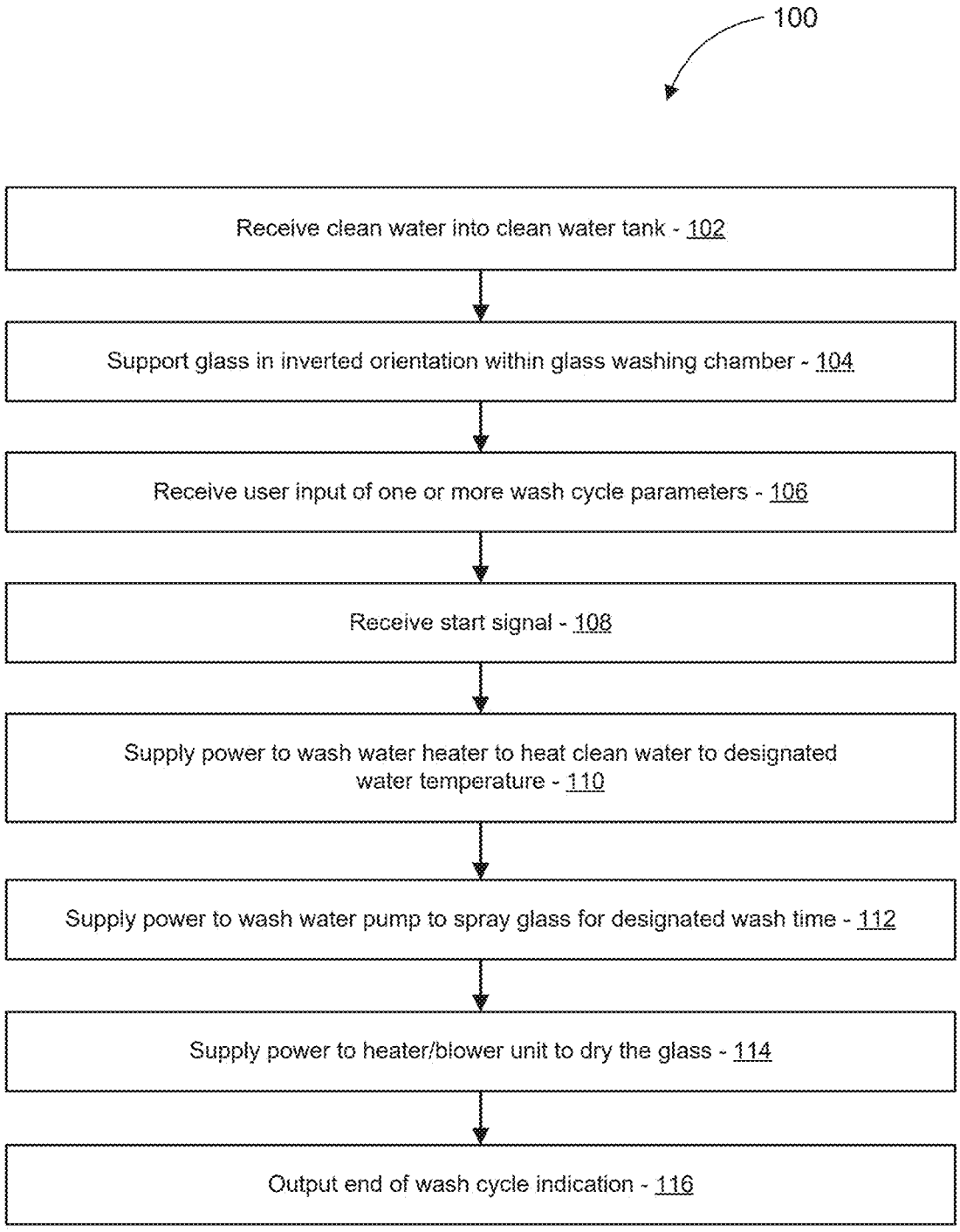
FIG. 15 shows a simplified schematic diagram of a method of washing and drying a glass, in accordance with embodiments.

FIG. 15 shows a simplified schematic diagram of acts of a method 100 of operating a glass washing apparatus. While the method 100 is described herein with respect to operating the glass washing apparatus 10, the method 100 can be practiced in connection with any suitable glass washing apparatus.

In act 102, clean water is received into the clean water tank 24. Clean water can be added to the clean water tank 24 through the clean water inlet 20. In embodiments, the clean water tank 24 includes a transparent wall section through which the level of the clean water in the clean water tank 24 can be observed. In embodiments, the glass washing apparatus 10 includes a clean water level sensor configured to supply a clean water level signal to the control unit 108. In embodiments, the control unit 108 is configured to monitor the clean water level signal and display an "add water" message on the control panel 76 in response to the water level in the clean water tank 24 being lower than a minimum water level sufficient for the accomplishment of a cleaning cycle of the glass washing apparatus 10.

In act 104, a glass to be cleaned is supported in an inverted orientation within the glass washing chamber 16. For example, a wine glass (having a base, a bowl, and a stem via which the base and the bowl are connected) can be suspended in an inverted orientation from the glass holder 28 with the stem of the wine glass accommodated within the slot of the glass holder 28. For a glass without a stem (e.g., a tumbler style glass), a removable glass support can be placed into the glass cleaning chamber 16 and rest on the bottom panel 44. The removable glass support can have any suitable configuration that holds the glass in an inverted orientation and elevated and centered over the interior wash nozzle 36, and accommodates washing of the exterior and interior of the glass by the washing sprays emitted by the first side wash nozzle 30, the second side wash nozzle 32, the third side wash nozzle 34, and the interior wash nozzle 36. For example, the removable glass support can have a suitable open frame configuration formed from one or more suitable materials such as, but not limited to, a coated corrosion resistant metal wire or an injection molded plastic.

In act 106, the control unit 108 can receive one or more user inputs via the control panel 76 designating one or more cleaning cycle parameters for use in washing the glass. For example, as described herein, the user can designate the wash water temperature via the wash water temperature setting screen 82 of the control panel 76. The user can designate the wash cycle duration via the wash cycle duration setting screen 92 of the control panel 76. In embodiments, the user can designate one or more additional cleaning cycle parameters (e.g., drying air temperature, drying cycle duration) via the control panel 76.

In act 108, the control unit 108 receives a start signal from the control panel 76. For example, the control unit 108 can display a start cycle input button on the touch screen control panel 76 that can be pressed by the user to cause the control unit 108 to receive the start signal.

In act 110, in response to receiving the start signal, the control unit 108 controls transmission of electrical power to the wash water heater element 62 to heat the clean water in the clean water tank 24 to produce heated clean water having the designated wash water temperature. For example, the control unit 108 can control a suitable electrical power transmission control device (relay, power transistor) to control transmission of electrical power to the wash water heater element 62.

In act 112, the control unit 108 controls transmission of electrical power to the wash water pump assembly 58 to power to the wash water pump assembly 58 for the designated wash cycle duration to direct the first side washing spray, the second first side washing spray, and the third side washing spray of the heated clean water onto exterior surfaces of the glass, and to direct the interior washing spray into an interior cavity of the glass. For example, the control unit 108 can control a suitable electrical power transmission device (relay, power transistor) to control transmission of electrical power to the wash water pump assembly 58. In embodiments, the method 100 includes receiving dirty water from the glass washing chamber 16 into the dirty water tank 26.

In act 114, the control unit 108 controls transmission of electrical power to the heater/blower unit 66 to supply a flow of heated air into the glass washing chamber 16 to dry the glass. For example, the control unit 108 can control a suitable electrical power transmission device (relay, power transistor) to control transmission of electrical power to the heater/blower unit 66. In embodiments of the method 100, the heater blower unit supplies: (a) the flow of heated air into the glass washing chamber through a first side wall of the glass washing chamber, (b) a second flow of heated air into the glass washing chamber through a second side wall of the glass washing chamber, and (c) a third flow of heated air into the glass washing chamber through a back wall of the glass washing chamber. In embodiments, the method 100 includes redirecting a portion of the third flow of heated air into the interior cavity of the glass via an airflow deflector.

In act 116, following completion of the drying cycle, the control unit 108 displays an end of wash cycle indication on the control panel 76. Any suitable end of wash cycle indication can be displayed on the control panel 76.

Figure 16:
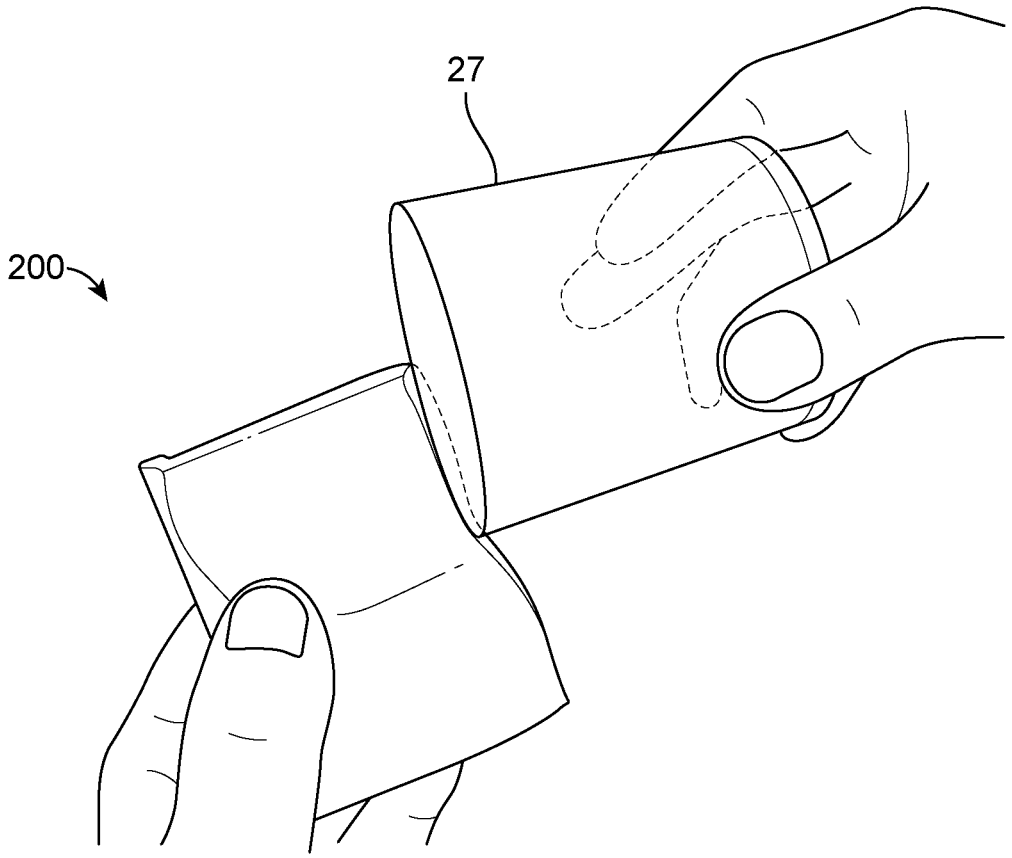
FIG. 16 and FIG. 17 illustrate the use of a cleaning accessory to remove a lip-stick stain from a glass, in accordance with embodiments.
Figure 17:
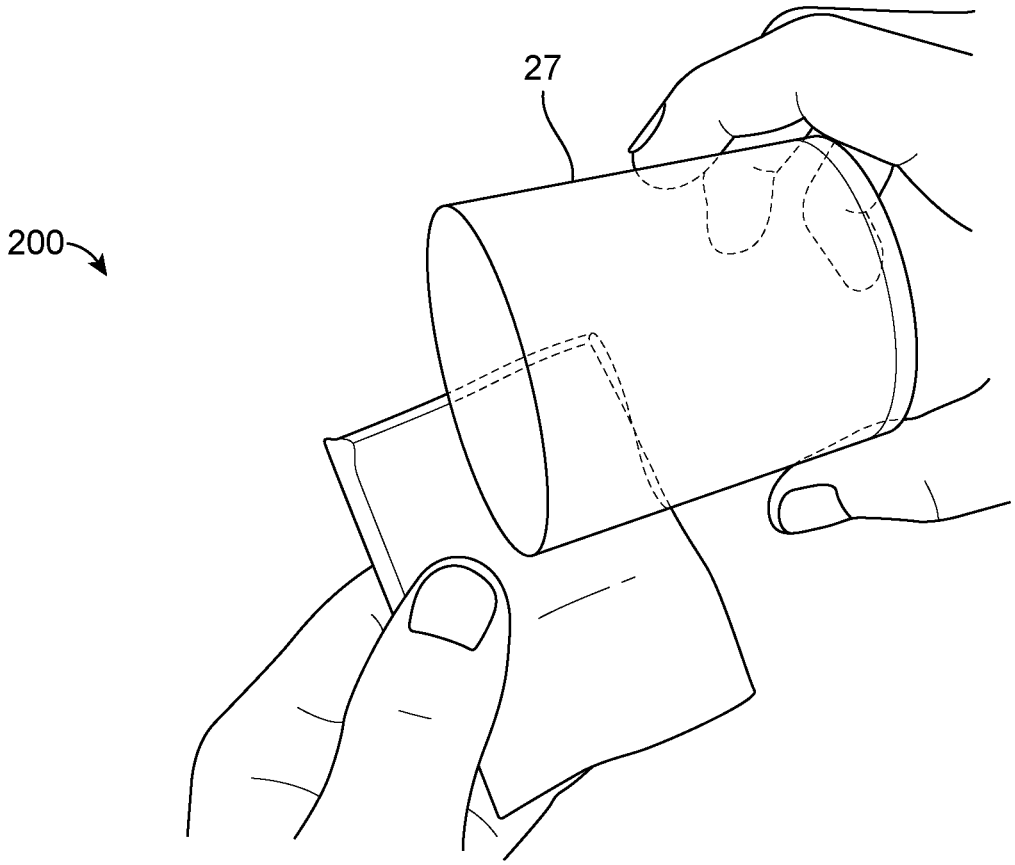

FIG. 16 and FIG. 17 illustrate the use of a cleaning accessory 200 to remove a lip-stick stain from a glass 27, in accordance with embodiments. FIG. 18 shows a cross-sectional view through the cleaning accessory 200. In the illustrated embodiment, the cleaning accessory 200 includes a support plate 202, two cylindrical supports 204, and two cleaning membranes 206. The cylindrical supports 204 are mounted to the support plate 202 and extend to one side thereof. Each of the cleaning membranes 206 extend around one of the cylindrical supports 204. The cleaning accessory 200 has a small gap 208 sized to accept and interface with a rim of a glass. To remove a lip-stick stain from a glass, the rim of the glass is inserted into the gap 208 and the glass is rotated relative to the cleaning accessory so that the lip-stick stain is transferred from the rim of the glass to the cleaning membranes 206. The cleaning accessory 200 can be made from any suitable materials. For example, in some embodiments, the support plate 202 and the cylindrical supports 204 can be made from a suitable plastic and the cleaning membranes can be made from a suitable rubber.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A glass washing apparatus comprising:

a housing that partially defines a glass washing chamber;

an access door mounted to the housing and reconfigurable between an open configuration providing access to the glass washing chamber and a closed configuration that defines a portion of the glass washing chamber;

a glass holder configured to hold a glass in an inverted orientation within the glass washing chamber;

a first side wash nozzle configured to emit a first side washing spray onto a first exterior portion of the glass, wherein the first side wash nozzle is mounted to a first side wall of the housing that defines a first side surface of the glass washing chamber;

a second side wash nozzle configured to emit a second side washing spray onto a second exterior portion of the glass, wherein the second side wash nozzle is mounted to a second side wall of the housing that defines a second side surface of the glass washing chamber;

a third side wash nozzle configured to emit a third side washing spray onto a third exterior portion of the glass, wherein the third side wash nozzle is mounted to a back wall of the housing that defines a back wall surface of the glass washing chamber;

an interior wash nozzle configured to emit an interior washing spray into an interior cavity of the glass, wherein the interior wash nozzle is mounted to a bottom panel of the housing that defines a bottom surface of the glass washing chamber;

a drying air outlet configured to emit a heated airflow into the glass washing chamber;

a vent configured for venting the glass washing chamber while the access door is in the closed configuration;

a clean water tank configured to receive clean water;

a dirty water tank configured to receive dirty water from the glass washing chamber;

a wash water heater;

a wash water temperature sensor;

a wash water pump;

a heater/blower unit;

a control panel; and a control unit configured to:

receive a start signal from the control panel;

control transmission of electrical power to the wash water heater to produce heated clean water by heating the clean water to a designated heated clean water temperature while monitoring a temperature of the heated clean water via the wash water temperature sensor;

control transmission of electrical power to the wash water pump to supply the heated clean water to the first side wash nozzle, the second side wash nozzle, the third side wash nozzle, and the interior wash nozzle to spray wash the glass over a wash cycle; and control transmission of electrical power to the heater/blower unit to supply a flow of heated air to the drying air outlet over a drying cycle.

2. The glass washing apparatus of claim 1, further comprising a drain member mounted to the bottom panel and comprising one or more apertures through which the glass washing chamber is in fluid communication with the dirty water tank.

3. The glass washing apparatus of claim 2, further comprising:

a second drying air outlet configured to output a second flow of heated air into the glass washing chamber from the second side wall of the housing; and a third drying air outlet configured to output a third flow of heated air into the glass washing chamber from the back wall of the housing, wherein the drying air outlet is configured to output the flow of heated air into the glass washing chamber from the first side wall of the housing.

4. The glass washing apparatus of claim 3, further comprising an airflow deflector attached to the bottom panel of the housing, wherein the airflow deflector is shaped to redirect a portion of the third flow of heated air into an interior cavity of the glass.

5. The glass washing apparatus of claim 4, wherein:

the drain member comprises the airflow deflector; and the third drying air outlet is configured to direct the third flow of heated air along the bottom panel to the airflow deflector.

6. The glass washing apparatus of claim 1, wherein:

the first side surface has a first side depth from the back wall surface to an inside surface of the access door in the closed configuration;

the first side wash nozzle is offset from the inside surface of the access door by less than ¼ of the first side depth;

the second side surface has a second side depth from the back wall surface to an inside surface of the access door in the closed configuration; and the second side wash nozzle is offset from the inside surface of the access door by less than ¼ of the second side depth.

7. The glass washing apparatus of claim 1, further comprising an airflow vent via which the glass washing chamber is vented to accommodate output of the flow of heated air from the glass washing chamber while the access door is in the closed configuration.

8. The glass washing apparatus of claim 1, further comprising a drain member mounted to the bottom panel, wherein the drain member comprises one or more apertures through which the glass washing chamber is in fluid communication with the dirty water tank.

9. The glass washing apparatus of claim 8, further comprising an airflow vent via which the dirty water tank is vented, wherein the drain member is configured to accommodate venting of the glass washing chamber to the dirty water tank to accommodate input of the flow of heated air into the glass washing chamber.

10. The glass washing apparatus of claim 1, further comprising:

a clean water inlet for filling the clean water tank with clean water; and a dirty water outlet assembly comprising a dirty water outlet valve reconfigurable between closed configuration for retaining the dirty water in the dirty water tank and an open configuration for draining the dirty water from the dirty water tank.

11. The glass washing apparatus of claim 1, wherein the control panel is configured to:

display a designated duration of the wash cycle; and accept user input to adjust the designated duration of the wash cycle.

12. The glass washing apparatus of claim 11, wherein the control panel is further configured to:

display a designated heated clean water temperature; and accept user input to adjust the designated heated clean water temperature.

13. The glass washing apparatus of claim 12, wherein the control panel is further configured to:

display a designated duration for the drying cycle; and accept user input to adjust the designated duration for the drying cycle.

14. The glass washing apparatus of claim 11, the control panel is further configured to:

display a currently designated temperature for the flow of heated air; and accept user input to adjust the currently designated temperature for the flow of heated air.

15. The glass washing apparatus of claim 1, wherein:

the glass is configured as a wine glass comprising a base, a bowl, and a stem connecting the base and the bowl;

the glass holder comprises a support member for supporting the wine glass via the base; and the support member comprises a slot configured to accommodate the stem.

16. The glass washing apparatus of claim 15, wherein the glass holder is reconfigurable between a deployed configuration for holding the wine glass and a stowed configuration that accommodates a removable glass holder within the glass washing chamber for holding the glass in the inverted orientation.

* * * * *